US007795538B2

(12) United States Patent
Kaiser et al.

(10) Patent No.: US 7,795,538 B2
(45) Date of Patent: Sep. 14, 2010

(54) FLEXIBLE INSULATED WIRES FOR USE IN HIGH TEMPERATURES AND METHODS OF MANUFACTURING

(75) Inventors: Mark Kaiser, Prospect Heights, IL (US); Devlin Gualtieri, Ledgewood, NJ (US); Belinda S. Foor, Chicago, IL (US); Mariola Proszowski, DesPlaines, IL (US); Rehan Zaki, Naperville, IL (US)

(73) Assignee: Honeywell International Inc., Morristown, NJ (US)

( * ) Notice: Subject to any disclaimer, the term of this patent is extended or adjusted under 35 U.S.C. 154(b) by 385 days.

(21) Appl. No.: 11/935,762

(22) Filed: Nov. 6, 2007

(65) Prior Publication Data

US 2009/0114416 A1 May 7, 2009

(51) Int. Cl.
*H01B 7/00* (2006.01)

(52) U.S. Cl. ..... 174/110 R

(58) Field of Classification Search .. 174/110 R–110 E, 174/36, 120 R, 121 R, 120 SR, 124 R, 124 G, 174/126.1, 126.2
See application file for complete search history.

(56) References Cited

U.S. PATENT DOCUMENTS

| | | | | |
|---|---|---|---|---|
| 2,421,652 | A | 6/1947 | Robinson et al. | |
| 2,707,703 | A | 5/1955 | Dorst | |
| 2,975,078 | A | 3/1961 | Rayfield | |
| 2,984,590 | A | 5/1961 | Anderson | |
| 3,089,787 | A | 5/1963 | Sattler | |
| 3,093,511 | A | 6/1963 | Weisel et al. | |
| 3,222,219 | A | 12/1965 | Saunders et al. | |
| 3,291,638 | A | 12/1966 | Stadlen et al. | |
| 3,343,984 | A | 9/1967 | Saums et al. | |
| 3,352,009 | A | 11/1967 | Cohn et al. | |
| 3,446,660 | A * | 5/1969 | Pendleton | 428/383 |
| 3,565,685 | A | 2/1971 | Suzuki | |
| 4,269,757 | A | 5/1981 | Mine et al. | |
| 4,342,814 | A | 8/1982 | Usuki et al. | |
| 4,429,007 | A | 1/1984 | Bich et al. | |
| 4,476,192 | A | 10/1984 | Imai et al. | |
| 5,139,820 | A | 8/1992 | Sawada et al. | |
| 5,154,954 | A | 10/1992 | Croop et al. | |
| 5,296,650 | A * | 3/1994 | Kobayashi et al. | 174/23 C |
| 5,350,638 | A | 9/1994 | Sawada et al. | |
| 6,407,339 | B1 | 6/2002 | Rice et al. | |
| 6,797,200 | B2 | 9/2004 | Scelza et al. | |
| 2006/0099429 | A1 * | 5/2006 | Domes et al. | 428/447 |

FOREIGN PATENT DOCUMENTS

| | | |
|---|---|---|
| CN | 1760994 | 4/2006 |

(Continued)

OTHER PUBLICATIONS

EP Search Report dated Feb. 10, 2009, EP 08168427.6-1214.

*Primary Examiner*—William H Mayo, III
(74) *Attorney, Agent, or Firm*—Ingrassia Fisher & Lorenz, P.C.

(57) ABSTRACT

Flexible insulated wires for use in a high temperature environment include a conductor and a coating over the conductor. The coating is formulated from a dielectric material and an organic binder having an organic component, wherein the organic component has been substantially decomposed from the coating during manufacture. The flexible insulated wire may be incorporated into a component.

13 Claims, 2 Drawing Sheets

FOREIGN PATENT DOCUMENTS

| | | | | |
|---|---|---|---|---|
| EP | 0 435 154 | A1 | * | 12/1990 |
| EP | 0435154 | A1 | | 7/1991 |
| EP | 0460238 | A1 | | 12/1991 |
| FR | 2573910 | A1 | | 5/1986 |
| GB | 803499 | | | 10/1958 |
| WO | 2006032559 | A1 | | 3/2006 |

* cited by examiner

FLEXIBLE INSULATED WIRES FOR USE IN HIGH TEMPERATURES AND METHODS OF MANUFACTURING

TECHNICAL FIELD

The inventive subject matter relates generally to insulated wires, and more particularly relates to methods of forming flexible high temperature insulated wires.

BACKGROUND

Insulated wires are used in myriad applications. For instance, insulated wires may be used to create electromagnetic devices, such as motors. In particular, the wires may form coils that are wound around a magnetic core. When current flows through the wires, a magnetic field is created which may cause the core to move and produce a force. In other cases, the insulated wires may be used as part of a sensor, such as a linear variable differential transformer. Here, the wires may make up a primary winding and a secondary winding that define a bore, and a magnetic core may be disposed in the bore. The magnetic core may be configured to move axially within the bore relative to the wound wires and cause a differential current flow through the windings.

Typically, the insulated wires are made from a conductive material that is coated with an insulating material. The insulating material may be polyimide, Teflon® (available through E.I. DuPont de Nemours, Inc. of Delaware), polyvinyl chloride (PVC) or other suitable material offering insulative properties. These materials may be applied to the wire via a spraying, drawing or an electrolytic process. Polyimide insulated wires are relatively inexpensive and simple to manufacture and operate sufficiently under most circumstances. However, they may have an upper continuous working temperature limit of about 240° 0C. In cases in which the insulated wires may be exposed to temperatures greater than 240° C., the polyimide insulated wires may either be disposed in a protective housing, or may be replaced with other types of insulated wires. Teflon® may be used to increase the operating temperature to a working temperature of 260° C. and a maximum excursion temperature near 300° C., but results in increased cost and thickness. Other insulating materials which offer good dielectric properties, such as silicon oxides, offer higher temperature stability but cannot be bent or formed after the insulative material has been created. Thus, use of these types of insulated wires may be dependant on applications in which space constraints are not a concern, temperature can be controlled, or materials can be formed and cured in the final application.

Accordingly, it is desirable to have an insulated wire that may be used in relatively high temperature environments (e.g., greater than about 240° C.) and may be bent into a desirable shape at any time after being coated with the insulation. In addition, it is desirable to have a relatively inexpensive and simple method for manufacturing such insulated wires. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Flexible insulated wires for use in a high temperature environment and methods of forming the wires are provided.

In an embodiment, by way of example only, the wire may include a conductor and a coating over the conductor, the coating formulated from a dielectric material and an organic binder having an organic component, wherein the organic component has been substantially decomposed from the coating during manufacture.

In another embodiment, by way of example only, a component includes a core and a flexible insulated wire wrapped at least partially around the core. The flexible insulated wire includes a conductor and a coating over the conductor, the coating formulated from a dielectric material and an organic binder having an organic component, wherein the organic component has been substantially decomposed from the coating during manufacture of the flexible insulated wire.

In still another embodiment, by way of example only, a method of manufacturing a flexible insulated wire for use in a high temperature environment is included. The method includes applying a mixture to a conductor to form a coated conductor having a surface, the mixture comprising a dielectric material and an organic binder having an organic component, and heat-treating the coated conductor to decompose substantially all of the organic component in the coated conductor to form the flexible insulated wire.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the inventive subject matter or the application and uses of the inventive subject matter. Furthermore, there is no intention to be bound by any theory presented in the preceding background or the following detailed description.

Figure 1:
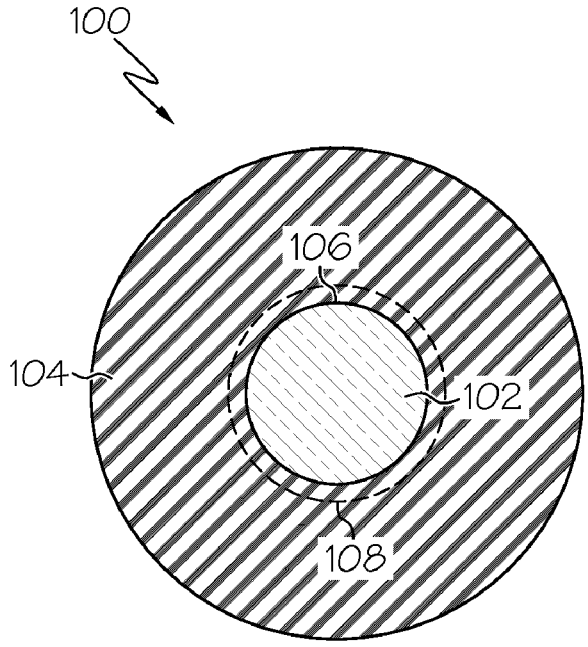
FIG. 1 is a simplified cross-sectional view of an insulated wire, according to an embodiment.

FIG. 1 is a cross-sectional view of an insulated wire 100, according to an embodiment. The wire 100 includes one or more conductors 102 (for clarity, only one is shown) and a coating 104 over the conductor 102. The conductor 102 may be any one of numerous conductive materials, such as a metal or metal alloy. Suitable conductive materials include, but are not limited to of nickel, copper, aluminum, silver, and alloys thereof. In an embodiment, the conductor 102 may include a main body 106 that is made of a first conductive material and a layer 108 that is made of a second conductive material. The first conductive material may be formulated such that it is more conductive than the second conductive material, but may have a lower melting point than the second conductive material. In one example, the main body 106 may be copper, while the layer 108 may be nickel.

The coating 104 coats at least a portion of the length of the conductor 102. In an embodiment, the coating 104 has an inner surface that contacts a surface of the conductor 102. In another embodiment, the coating 104 comprises an amorphous structure and a crystalline interface is disposed on the coating inner surface to thereby contact the conductor surface. In this regard, the coating 104 may be formulated from a dielectric material and an organic binder having an organic component, wherein the organic component has been substantially decomposed from the coating during manufacture. The dielectric material may be a material having a relatively low dielectric constant suitable for insulating the conductor 102. In an embodiment, the dielectric material may have a dielectric constant (κ) that is less than 10. In another embodiment, the dielectric constant may be a value in a range of between about 1 and about 10. In embodiments in which the insulated wire 100 will be used in alternating current applications, the dielectric constant of the material may trend towards one (1). The dielectric material may be capable of insulating the conductor 102 when exposed to temperatures that may be greater than 240° C. Suitable materials having the aforementioned properties include, but are not limited to, alumina, silica, silica aluminate, zeolites, boron nitride, and other suitable inorganic oxides.

Figure 2:
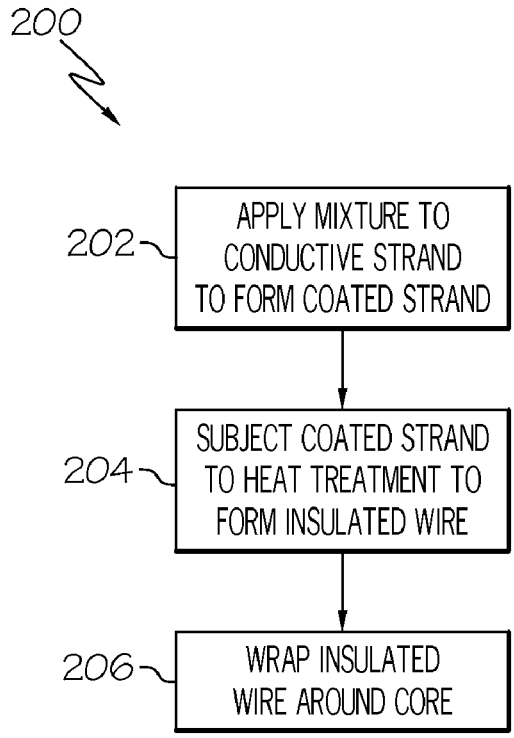
FIG. 2 is a method of manufacturing a flexible insulated wire, according to an embodiment.

With additional reference to FIG. 2, a method 200 of manufacturing a flexible insulated wire 100 is depicted in FIG. 2. In an embodiment, the method 200 includes applying a mixture to a conductor to form a coated conductor, where the mixture comprises an aqueous blend of dielectric material and a binder including an organic component, step 202. The coated conductor is then subjected to a heat treatment to decompose substantially all of the organic component therefrom to thereby form the insulated wire 100, step 204. In one embodiment, it may be wound around a core, step 206. Each of these steps will now be discussed in more detail below.

As mentioned briefly above, a mixture is applied to a conductor, step 202. The conductor may be any one of numerous conventionally-used conductive materials, such as nickel, copper, aluminum, silver, and alloys thereof. In an embodiment, the conductor may be a single conductor or a bundle of multiple conductors. In another embodiment, the conductor may be made up of a main body including a layer thereon. In such case, the main body may be a first conductive material, such as nickel, copper, aluminum, silver, or an alloy thereof, and may be coated with a second conductive material to form the layer. The second conductive material may be a conductive material with a higher melting point than the first conductive material. In any case, the selection of each conductive material may depend on the particular temperature environment to which the insulated wire 100 may be subjected, either during or after the manufacturing process. The conductor may either be obtained commercially, or may be formed as part of method 200.

The mixture includes dielectric material and a binder. The dielectric material may be any one of numerous insulating materials used for the coating 104 mentioned above, and may be, for example, an alumina, a silica, silica aluminate, zeolite, boron nitride, or another suitable inorganic oxide. The binder may comprise an organic component that can be substantially completely decomposed when subjected to heat treatment. In an embodiment, the organic component may include at least one polymeric component and an oxygen atom. Such an organic component may more readily decompose upon exposure to a heat treatment as compared with other types of organic components. Suitable organic components include, but are not limited to, polyvinyl alcohol, polyethylene oxide, or a combination of both.

In an embodiment, the mixture may be manipulated to obtain a desired range of particle sizes. In another example, the mixture may be manipulated to obtain a uniform consistency. In these regards, the mixture may be milled, mixed or blended, however it is preferable that the material be milled, such as with a ball mill, in order to maintain a uniform particle size. To ensure that the mixture adheres to the conductor when applied thereto, the mixture may comprise predetermined amounts of the dielectric material, the binder, and water. In an embodiment in which the binder is an aqueous binder, the binder may be made up of a polymer blend of polyvinyl alcohol and polyethylene oxide with water. In an example, the polymer blend may include polyvinyl alcohol and polyethylene oxide at a ratio of about 2.5:1 by weight, and the polymer blend and water may be present in the binder at a ratio of about 1:18 by weight. In such case, the mixture may include between about 5% and about 15% by weight of the dielectric material, with a balance of the mixture made up of the aqueous binder.

The mixture may be applied to the conductor in any manner such that desired portions of the conductor are coated to a desired thickness. In one embodiment, an entirety of the conductor is coated with the mixture. In another embodiment, the desired thickness may be in a range of between about 0.025 mm to about 0.127 mm (0.001 inch and about 0.005 inch). However, it will be appreciated that any thickness may be employed, and may depend on the purpose for which the insulated wire 100 may be used. In an embodiment, the mixture is sprayed onto the conductor. In another embodiment, the mixture is disposed in a container and the conductor is dipped or drawn through the mixture in the container to create intimate contact between the liquid and the conductor. After the coated conductor is formed, it may be dried to remove substantially all of the water therefrom. In an embodiment, a heated air stream is used to dry the coated conductor.

Next, the coated conductor is heat-treated to form the insulated wire 100, step 204. In an embodiment, the coated conductor is heat-treated to a predetermined temperature for a predetermined duration to decompose substantially all of the organic component on at least an outer surface of the coated conductor. In an embodiment, the heat treatment may occur at a temperature in a range of between about 200° C. and about 800° C. for between about 2 and 10 hours. Without being bound by theory, heat treating the coated conductor is thought to cause the mixture thereon to oxidize and decompose and to form gaseous organic byproducts, such as carbon dioxide and/or carbon monoxide. Because the organic byproducts are gaseous, they are emitted and thereby removed from the coated conductor, leaving the inorganic material from the mixture on the conductor. Decomposing the organic component in this way allows the inorganic material of the mixture to adhere to the conductor, while removing potentially conductive carbon from the coating. Additionally, the resultant coating 104 is also capable of being bent without cracking because microfissures form in the heat-treated dielectric material when the insulated wire 100 is flexed. As a result, the insulated wire 100 may be bent into a desired shape and used for various applications in which a flexible wire may be useful.

Figure 3:
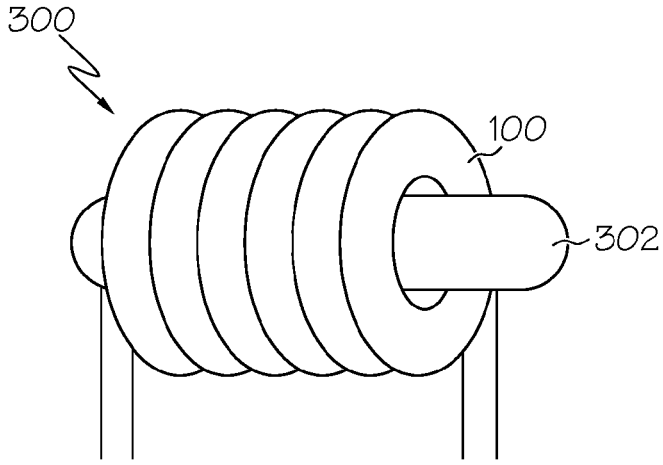
FIG. 3 is a side view of a simplified component including an insulated wire, according to an embodiment.

In an embodiment, the insulated wire 100 may be wound around a core, step 206. With additional reference to FIG. 3, a side view of a simplified component including a wound insulated wire 100 is provided, according to an embodiment. Here, the insulated wire 100 is used as a coil for an electromagnetic device 300, such as a motor, a sensor, a solenoid, or any other device including a transducer, inducer, or as a conductor on a printed wiring board. The core 302 may be made of a magnetically permeable material that is conventionally used in electromagnetic devices. For example, the core 302 may comprise iron, nickel, cobalt, alloys thereof or other suitable magnetic materials. Thus, when current flows through the insulated wire 100, a magnetic field is generated that causes the core 302 to move relative to insulated wire 100. The movement of the core 302 may be used to produce energy for use with another component.

Figure 4:
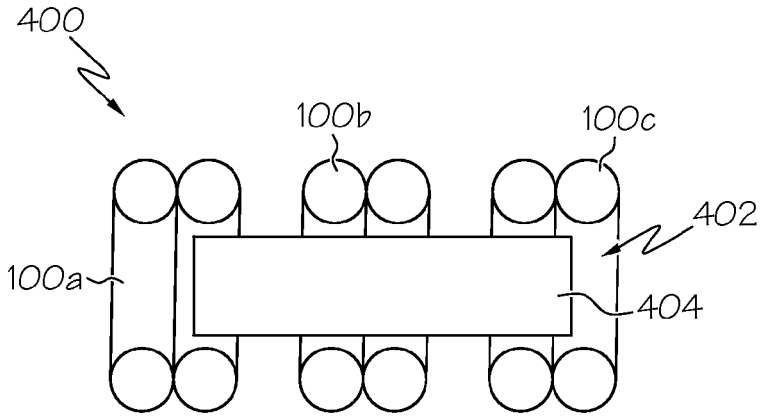
FIG. 4 is a cross-sectional view of a simplified sensor including insulated wires, according to an embodiment.

In another example, more than one insulated wire 100 may be used to form a sensor. FIG. 4 is a cross-sectional view of a sensor 400, according to an embodiment. The sensor 400 may be a position sensor, such as a linear variable differential transformer. Here, three wires 100*a*, 100*b*, 100*c* are wound to form a spiral shape having a bore 402 therethrough. A core 404 is disposed within the bore 402 and is configured to have a length that is less than a length of the bore 402. In this way, when current flows through wires 100*b*, a voltage is present in wires 100*a* and 100*c*, and the ratio of these voltages as the core 404 moves within the bore 402.

Figure 5:
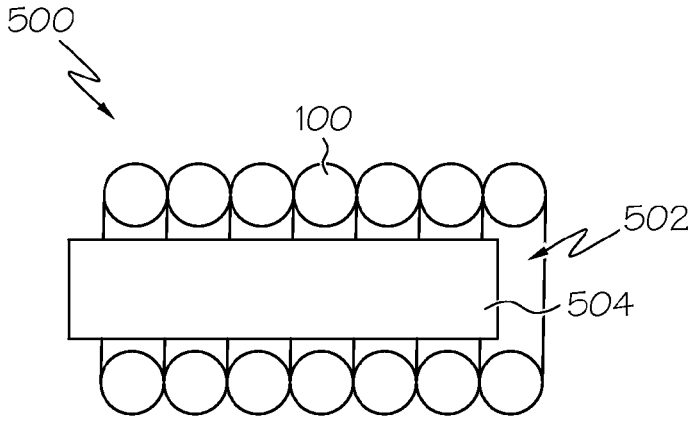
FIG. 5 is a cross-sectional view of a simplified actuator including insulated wires, according to an embodiment.

In another example, an insulated wire 100 may be used to form an actuator. FIG. 5 is a cross-sectional view of an actuator 500, according to an embodiment. The actuator 500 may be an actuator, such as a solenoid actuator. Here, the wire 100 is wound to form a spiral shape having a bore 502 therethrough. A core 504 is disposed within the bore 502 and is configured to have a portion of its length inserted into the bore 502. In this way, when current flows through the wire 100, a force will be exerted on the core 504, and the core 504 will move within the bore 502.

The following example is presented in order to provide a more complete understanding of the inventive subject matter. The specific techniques, conditions, materials and reported data set forth as illustrations, are exemplary, and should not be construed as limiting the scope of the inventive subject matter.

Samples of nickel and silver were coated with a mixture including zeolite and a binder. The mixture included 12% zeolite, by weight, and balance of the binder. The binder included a polymer blend of polyvinyl alcohol and polyethylene oxide at a ratio of about 2.5:1, by weight, where the polymer blend was present with water at a ratio of 1:18 by weight. The coated coupons were spray or dip-coated and pre-treated at 200° C. The coated coupons were then subjected to a final heat treatment at 800° C. for 10 hours. It was found that the coating demonstrated good adhesion, flexibility and electrical performance.

In one particular example, a 0.3 m sample of a silver wire having a 1.5 mm thickness and having the coating described above thereon was wound around a 6 mm sample of stainless steel tubing. The insulated silver wire was evaluated at 500° C. and demonstrated a breakthrough voltage of 400V and an insulation resistance of 650 kΩ. In another example, a 3 m length of nickel wire was tested. Here, the mixture was sprayed onto the nickel wire and the wire was subjected to a temperature of about 800° C. for about 5 hours. The wire was tested at 500° C. and had a breakthrough voltage of 250V and an insulation resistance of 300 kΩ.

An insulated wire and methods of manufacturing the wire have now been provided that may be used in high temperature environments (e.g., greater than about 240° C.) and may be bent into a desirable shape. In addition, the insulated wires may be relatively inexpensive and simple to manufacture.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A flexible insulated wire manufactured for use in a high temperature environment comprising:

a conductor; and a coating over the conductor, the coating formulated from a dielectric material and an organic binder having an organic component, wherein the dielectric material comprises a material selected from the group consisting of zeolite and silica aluminate, the organic binder comprises polyvinyl alcohol and polyethylene oxide, and the organic component of the organic binder has been substantially decomposed and removed from the coating after exposure to a temperature in a range of about 200° C. to about 800° C. for about 2 hours to about 10 hours during manufacture leaving the inorganic dielectric material in the coating.

2. The flexible insulated wire of claim 1, wherein the dielectric material has a dielectric constant less than about 10.

3. The flexible insulated wire of claim 1, wherein:

the conductor has a surface;

the coating has an inner surface; and the coating comprises an amorphous structure and a crystalline interface disposed on the coating inner surface contacting the conductor surface.

4. The flexible insulated wire of claim 3, wherein:

the dielectric material comprises an inorganic oxide formulated to form the amorphous structure.

5. The flexible insulated wire of claim 1, wherein the conductor comprises a metal comprising a material selected from the group consisting of nickel, copper, aluminum, silver, and alloys thereof.

6. The flexible insulated wire of claim 1, wherein the conductor comprises a main body and a layer over the main body, the main body comprising copper and the layer comprising nickel.

7. A component comprising:

a core; and a flexible insulated wire wrapped at least partially around the core, the flexible insulated wire comprising:

a conductor; and a coating over the conductor, the coating formulated from a dielectric material and an organic binder having an organic component, wherein the dielectric material comprises a material selected from the group consisting of zeolite and silica aluminate, the organic binder comprises polyvinyl alcohol and polyethylene oxide, and the organic component of the organic binder has been substantially decomposed and removed from the coating after exposure to a temperature in a range of about 200° C. to about 800° C. for about 2 hours to about 10 hours during manufacture of the flexible insulated wire leaving the inorganic dielectric material in the coating.

8. The component of claim 7, wherein the core comprises magnetically permeable material.

9. The component of claim 7, wherein the dielectric material has a dielectric constant less than about 10.

10. A method of manufacturing a flexible insulated wire for use in a high temperature environment, the method comprising the steps of:

applying a mixture to a conductor to form a coated conductor having a surface, the mixture comprising a dielectric material and an organic binder having an organic component, the dielectric material comprising a material selected from the group consisting of zeolite and silica aluminate, and the organic binder comprises polyvinyl alcohol and polyethylene oxide; and heat-treating the coated conductor by exposing the coated conductor to a temperature in a range of about 200° C. to about 800° C. for about 2 hours to about 10 hours to decompose and remove substantially all of the organic component of the organic binder in the coated conductor to form a coating on the flexible insulated wire and to leave the inorganic dielectric material in the coating.

11. The method of claim 10, further comprising the step of:

obtaining a uniform consistency of the mixture, before the step of applying.

12. The method of claim 10, further comprising drying the coated conductor with a hot air source, before the step of heat-treating.

13. The method of claim 10, wherein the organic binder comprises polyvinyl alcohol, polyethylene oxide, and balance water.

* * * * *